US005942365A

United States Patent [19]

Gibson et al.

[11] Patent Number: 5,942,365

[45] Date of Patent: Aug. 24, 1999

[54] DEVELOPER COMPOSITIONS AND IMAGING PROCESSES

[75] Inventors: George A. Gibson, Fairport; Scott D. Chamberlain, Macedon; Thomas R. Pickering; John W. Spiewak, both of Webster; Jacques C. Bertrand, Ontario; Roger N. Ciccarelli, Rochester; Denise R. Bayley, Fairport, all of N.Y.

[73] Assignee: Xerox Corporation, Stamford, Conn.

[21] Appl. No.: 08/878,689

[22] Filed: Jun. 19, 1997

Related U.S. Application Data

[63] Continuation of application No. 08/606,956, Feb. 26, 1996, abandoned.

[51] Int. Cl.[6] ..... G03G 9/135; G03G 13/10

[52] U.S. Cl. ..... 430/115; 430/117

[58] Field of Search ..... 430/115, 137, 430/117

[56] References Cited

U.S. PATENT DOCUMENTS

| | | | |
|---|---|---|---|
| 3,852,208 | 12/1974 | Nagashima et al. | 252/62.1 |
| 3,933,664 | 1/1976 | Nagashima et al. | 252/62.1 |
| 4,024,084 | 5/1977 | Sittardt et al. | 430/115 |
| 4,113,641 | 9/1978 | Brana et al. | 252/62.1 |
| 4,139,483 | 2/1979 | Williams et al. | 252/62.1 |
| 4,248,954 | 2/1981 | Datta et al. | 430/97 |
| 4,268,598 | 5/1981 | Leseman et al. | 430/107 |
| 4,388,396 | 6/1983 | Nishibayshi et al. | 430/126 |
| 4,468,446 | 8/1984 | Mikami | 430/138 |
| 4,524,119 | 6/1985 | Luly et al. | 430/108 |
| 4,707,429 | 11/1987 | Trout | 430/115 |
| 4,760,009 | 7/1988 | Larson | 430/137 |
| 5,019,477 | 5/1991 | Felder | 430/115 |
| 5,026,621 | 6/1991 | Tsubuko et al. | 430/109 |
| 5,028,508 | 7/1991 | Lane et al. | 430/115 |
| 5,030,535 | 7/1991 | Drappel et al. | 430/116 |
| 5,034,299 | 7/1991 | Houle | 430/115 |
| 5,045,425 | 9/1991 | Swindler | 430/115 |
| 5,069,995 | 12/1991 | Swidler | 430/115 |
| 5,223,368 | 6/1993 | Ciccarelli et al. | 430/110 |
| 5,306,591 | 4/1994 | Larson et al. | 430/115 |
| 5,308,731 | 5/1994 | Larson et al. | 430/115 |
| 5,324,613 | 6/1994 | Ciccarelli et al. | 430/110 |
| 5,366,840 | 11/1994 | Larson et al. | 430/115 |

*Primary Examiner*—Christopher D. Rodee
*Attorney, Agent, or Firm*—Annette L. Bade

[57] ABSTRACT

A liquid developer comprised of a liquid, resin particles, an optional nonpolar liquid soluble charge director, and a charge adjuvant comprised of an aluminum salt of an acid, wherein the acid is a hydroxy carboxylic acid, an amino carboxylic acid, an aromatic carboxylic acid, an aliphatic carboxylic acid, or a sulfonic acid and imaging processes using the same one disclosed.

29 Claims, 1 Drawing Sheet

DEVELOPER COMPOSITIONS AND IMAGING PROCESSES

This application is a continuation of application Ser. No. 08/606,956, filed Feb. 26, 1996, now abandoned.

BACKGROUND OF THE INVENTION

The present invention relates to developer compositions and, in particular, to liquid developers containing novel charge control agents. In embodiments, the present invention relates to liquid developers comprising acid aluminum salt charge control agents such as aluminum salts of acids, especially hydroxy carboxylic acids, amino carboxylic acids, sulfonic acids, aliphatic carboxylic acids, and aromatic carboxylic acids.

The developers of the present invention can be selected for a number of known imaging and printing systems, such as xerographic processes, wherein latent images are rendered visible with the liquid developer illustrated herein. The image quality, solid area coverage and resolution for developed images usually require sufficient toner particle electrophoretic mobility. The mobility for effective image development is primarily dependent on the imaging system used. The electrophoretic mobility is primarily directly proportional to the charge on the toner particles and inversely proportional to the viscosity of the liquid developer fluid. A 10 to 30 percent change in fluid viscosity caused, for instance, by a 5° to 15° C. decrease in temperature could result in a decrease in image quality, poor image development and background development, for example, because of a 5 percent to 23 percent decrease in electrophoretic mobility. Insufficient particle charge can also result in poor transfer of the toner to paper or other final substrates. Poor or unacceptable transfer can result in, for example, poor solid area coverage if insufficient toner is transferred to the final substrate and can also lead to image defects such as smears and hollowed fine features. To overcome or minimize such problems, the liquid toners of the present invention were arrived at after extensive research efforts, and which toners result in, for example, sufficient particle charge for transfer and maintain the mobility within the desired range of the particular imaging system employed. Advantages associated with the present invention include increasing the desired negative charge on the developer particles and in embodiments providing a charge adjuvant, also referred to as a charge additive, charge agent, charge control agent, or charge enhancer, that is superior to other charge adjuvants, such as aluminum stearate. The superior charge can result in improved image development and superior image transfer.

A latent electrostatic image can be developed with toner particles dispersed in an insulating nonpolar liquid. The aforementioned dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, it is developed by colored toner particles dispersed in a nonpolar liquid. The image may then be transferred to a receiver sheet or supporting substrate.

Useful liquid developers can comprise a thermoplastic resin and a dispersant nonpolar liquid. Generally, a suitable colorant, such as a dye or pigment, is also present. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 30 micrometers average by area size as measured using the Malvern 3600E particle sizer.

Since the formation of proper images depends, for example, on the difference of the charge between the toner particles in the liquid developer and the latent electrostatic image to be developed, it has been found desirable to add a charge director compound and charge adjuvants which increase the magnitude of the charge, such as polyhydroxy compounds, amino alcohols, polybutylene succinimide compounds, aromatic hydrocarbons, metallic soaps, and the like to the liquid developer comprising the thermoplastic resin, the nonpolar liquid and the colorant.

U.S. Pat. Nos. 5,223,368 and 5,324,613, both to Ciccarelli et al, the disclosures of which are totally incorporated by reference herein in their entireties, disclose negatively charged dry toners containing resin, pigment and an aluminum hydroxide charge additive, or the hydrates thereof, and developer compositions with the aforementioned toner and imaging processes thereof. Aluminum salts of alkylated salicylic acid, such as hydroxy bis [3,5-tertiary butyl salicylic] aluminate are disclosed as charge control agents.

U.S. Pat. No. 5,308,731 discloses a liquid developer comprised of a liquid, thermoplastic resin particles, a nonpolar liquid soluble charge director, and a charge adjuvant comprised of metal hydroxy acid complexes such as aluminum hydroxycarboxylic acids, and more specifically, aluminum salicylate, as charge adjuvants. The disclosure of this patent is herein incorporated by reference in its entirety.

Illustrated in U.S. Pat. No. 5,306,591 is a liquid developer comprised of a liquid component, thermoplastic resin, an ionic or zwitterionic charge director, or directors soluble in a nonpolar liquid; and a charge additive, or charge adjuvant comprised of an imine bisquinone. Illustrated in U.S. Stat. Inv. Reg. No. H1483 is a liquid developer comprised of thermoplastic resin particles, and a charge director comprised of an ammonium diblock copolymer.

In U.S. Pat. No. 5,366,840, there is disclosed a liquid developer comprised of thermoplastic resin particles, an optional charge director, and a charge additive comprised of aluminum-di-tertiary-butyl salicylate or ALOHOS. The disclosure of this reference is hereby incorporated by reference in its entirety.

U.S. Pat. No. 5,019,477 to Felder, the disclosure of which is hereby incorporated by reference in its entirety, discloses a liquid electrostatic developer comprising a nonpolar liquid, thermoplastic resin particles, and a charge director. The ionic or zwitterionic charge directors may include both negative charge directors such as lecithin, oil-soluble petroleum sulfonate and succinimide, and positive charge directors such as cobalt and iron naphthanates. The thermoplastic resin particles can comprise a mixture of (1) a polyethylene heteropolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) selected from the group consisting of vinyl toluene and styrene and (iv) selected from the group consisting of butadiene and acrylate. As the copolymer of polyethylene and methacrylic acid or methacrylic acid alkyl esters, NUCREL$^R$ may be selected.

U.S. Pat. No. 5,030,535 to Drappel et al. discloses a liquid developer composition comprising a liquid vehicle, a charge control additive and toner particles. The toner particles may contain pigment particles and a resin selected from the group consisting of polyolefins, halogenated polyolefins and mixtures thereof. The liquid developers are prepared by first dissolving the polymer resin in a liquid vehicle by heating at temperatures of from about 80° C. to about 120° C., adding pigment to the hot polymer solution and attriting the mixture, and then cooling the mixture so that the polymer becomes insoluble in the liquid vehicle, thus forming an insoluble resin layer around the pigment particles.

U.S. Pat. Nos. 3,852,208 and 3,933,664, both to Nagashima et al., disclose colored, light-transparent photoconductive material which is obtained by a condensation reaction of organic photoconductive substances with reactive colored components. The chemical combination of an organic photoconductive substance having at least one amino or hydroxyl group with a color development component having at least one active halogen atom produces the color developing organic photoconductive materials. Alternatively, the color developing materials can be obtained from the combination of an organic photoconductive substance having at least one active halogen atom with a color developing component having at least one amino or hydroxyl group. The color developing organic photoconductive material may be pulverized in a ballmill, a roll-mill or an atomizer to produce a toner for use as a dry or wet developing agent, or may be used in combination with other colored substances or vehicle resins.

U.S. Pat. No. 4,524,119 to Luly et al. discloses electrophotographic dry development carriers for use with toner particles wherein the carrier core particles are coated with fluorinated carbon or a fluorinated carbon-containing resin. By varying the fluorine content of the fluorinated carbon, systematic uniform variation of the resistivity properties of the carrier is permitted. Suitable binders for use with the carrier core particles may be selected from known thermoplastics, including fluoropolymers.

U.S. Pat. No. 5,026,621 to Tsubuko et al. discloses a toner for electrophotography which comprises as main components a coloring component and a binder resin which is a block copolymer comprising a functional segment (A) consisting of at least one of a fluoroalkylacryl ester block unit or a fluoroalkyl methacryl ester block unit, and a compatible segment (B) consisting of a fluorine-free vinyl or olefin monomer block unit. The functional segment of block copolymer is oriented to the surface of the block polymer and the compatible segment thereof is oriented to be compatible with other resins and a coloring agent contained in the toner, so that the toner is provided with both liquid repelling and solvent soluble properties.

U.S. Pat. No. 4,248,954 to Datta et al. discloses carrier particles for use with a dry toner composition in an electrophotographic process, which are prepared by coating the surface of the carrier particles with a perfluorocarboxylic acid in a polymeric binder. The carrier particles are capable of imparting a positive triboelectric charge to toners used with these carrier particles.

U.S. Pat. No. 4,268,598 to Leseman et al. discloses a developing powder composition prepared by blending a fluoroaliphatic sulfonamido surface active agent with a desired formulation of toner powder particles. The toner powders are flowable, fimely divided dry powder that are generally colored and are preferably conductive and magnetically attractable.

U.S. Pat. No. 4,139,483 to Williams et al. discloses a finely divided dry toner composition comprising a colorant, a thermoplastic resin, and a surface active additive which is capable of providing a desired polarity and magnitude of triboelectric charging potential to the toner composition. The surface active additives are selected from highly fluorinated materials.

U.S. Pat. No. 4,113,641 to Brana et al. discloses a dry development powder with a high charge to mass ratio comprising a carrier particle treated with a perfluoroalkyl sulfonic acid. The core of the carrier particle is any material which can react chemically with perfluoro sulfonic acid, and is preferably a ferromagnetic material such as iron or steel.

U.S. Pat. No. 4,388,396 to Nishibayashi et al. discloses developer particles comprising pigment particles, a binder and an offset-preventing agent selected from the group consisting of aliphatic fluorocarbon compounds and fluorochlorocarbon compounds. Electrical conductivity can be imparted to the developer by causing electrically conductive fine particles to adhere to the surfaces of the particles.

U.S. Pat. No. 4,468,446 to Mikami et al. discloses a dry electrostatographic toner for a pressure fixing process which comprises encapsulated toner particles with a pressure fixable adhesive core material containing a colorant and a pressure rupturable shell enclosing the core material, wherein the outer surface of the shell is an organofluoro compound.

Moreover, in U.S. Pat. No. 4,707,429 there are illustrated, for example, liquid developers with an aluminum stearate charge additive. Liquid developers with charge directors are also illustrated in U.S. Pat. No. 5,045,425. Further, stain elimination in consecutive colored liquid toners is illustrated in U.S. Pat. No. 5,069,995. Additionally, of interest are U.S. Pat. Nos. 4,760,009; 5,034,299 and 5,028,508.

In pending U.S. application Ser. No. 986,316, the disclosure of which is hereby incorporated herein by reference in its entirety, there is illustrated a process for forming images which comprises (a) generating an electrostatic latent image; (b) contacting the latent image with a developer comprising a colorant and a substantial amount of a vehicle with a melting point of at least about 25° C., said developer having a melting point of at least about 25° C., aid contact occurring while the developer is maintained at a temperature at or above its melting point, said developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development.

The disclosures of each of the U.S. patents just mentioned are incorporated herein by reference in their entirety.

SUMMARY OF THE INVENTION

Figure 1:
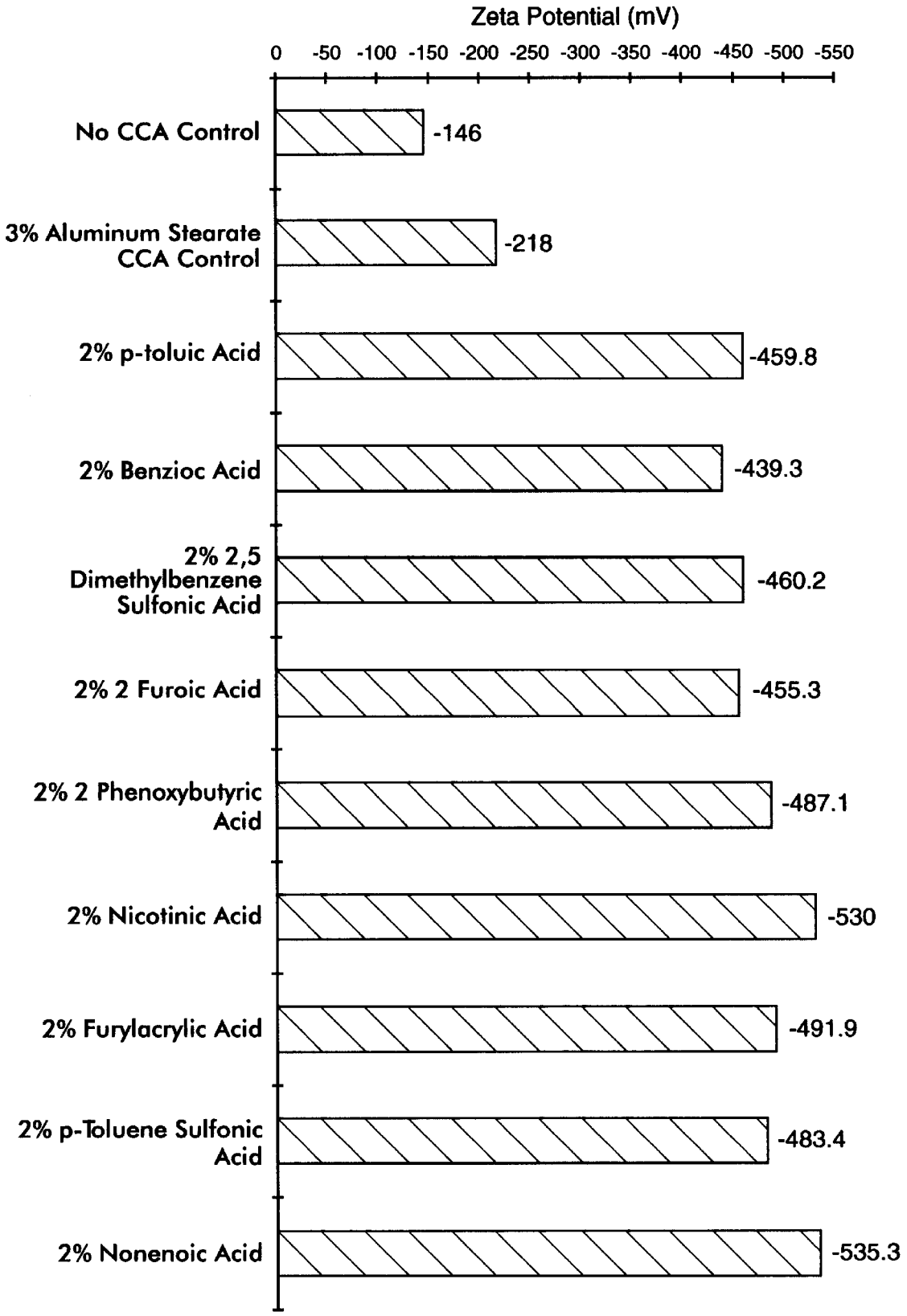
FIG. 1 is a bar graph showing the zeta potentials of toners containing various charge control agents. The zeta potentials were measured by ESA (Electro Acoustic Amplifier). Toners with charging potential of 200 mv are most effective.

Examples of objects of the present invention include:

It is an object of the present invention to provide methods with many of the advantages indicated herein.

It is an object of the present invention to provide negatively charged liquid developers.

Another object of the present invention is to provide liquid developers capable of high particle charging.

It is a further object of the invention to provide a negatively charged liquid developer comprising a charge enhancing agent comprising aluminum salts of hydroxy carboxylic acids.

It is another object of the invention to provide a negatively charged liquid developer comprising a charge enhancing agent comprising aluminum salts of amino carboxylic acids.

It is yet another object of the invention to provide a negatively charged liquid developer comprising a charge enhancing agent comprising aluminum salts of sulfonic acids.

Still another object of the present invention is to provide a negatively charged liquid developer comprising a charge enhancing agent comprising aluminum salts of aliphatic carboxylic acids.

Another object of the present invention is to provide a negatively charged liquid developer comprising a charge enhancing agent comprising aluminum salts of aromatic carboxylic acids.

It is still a further object of the invention to provide a liquid developer wherein developed image defects such as smearing, loss of resolution and loss of density are eliminated, or minimized.

Also, in another object of the present invention there are provided negatively charged liquid developers with certain charge enhancing agents which have higher negative particle charge which can result in improved image development and excellent image transfer.

Another object of the present invention is to provide a negatively charged liquid toner with aluminum salts of acids, which in embodiments, maintain mobility within a desired range.

It is yet another object of the present invention to provide imaging processes for forming color images.

Many of the above objects have been met by the present invention, in embodiments, which includes: negatively charged liquid developer comprising a nonpolar liquid, resin particles, an optional nonpolar liquid soluble ionic or zwitterionic charge director, preferably pigment, and a charge adjuvant comprised of an aluminum salt of an acid having the formula $R_1R_2R_3Al$, wherein $R_1$ is OH; $R_2$ is selected from the group consisting of OH, hydroxy carboxylic acids, alpha or beta amino acids with primary, and secondary or tertiary amino groups; and $R_3$ is selected from the group consisting of hydroxy carboxylic acids, alpha or beta amino acids with primary, secondary or tertiary amino groups, and a compound of the following formula (a):

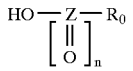

(a)

n=1 or 2; Z=carbon or sulfur wherein, when Z is carbon, n is 1 and $R_o$ is selected from the group consisting of hydrogen, alkyl from about 1 to about 20 carbons, alkenyl of from about 2 to about 20 carbons, cycloalkyl of from about 3 to about 7 carbons, aryl of from about 6 to about 18 carbons, alkylaryl of from about 7 to about 40 carbons, cycloalkylaryl of from about 8 to about 40 carbons and heteroaryl of from about 6 to about 18 carbons including heteroatoms of oxygen, nitrogen and sulfur, wherein $R_o$ may be substituted with alkoxy having from about 2 to about 20 carbons, carboalkoxy having from about 2 to about 20 carbons, alkoxy carbonyl having from about 2 to about 20 carbons, carboxamido, aldehydo, sulfonamido, nitro, cyano, and halogen groups, and when Z is sulfur, n is 2 and $R_o$ is an aryl of from about 6 to about 18 carbons, alkylaryl of from about 7 to about 40 carbons, cycloalkylaryl of from about 8 to about 40 carbons and heteroaryl of from about 6 to about 18 carbons including heteroatoms of oxygen, nitrogen and sulfur, and wherein $R_o$ may be substituted with alkoxy of from about 2 to about 20 carbons, carboalkoxy group of from about 2 to about 20 carbons, with the provision that when $R_2$ is 3,5-di-t-butyl salicylic acid, $R_3$ is not a salicylic acid or an alkoxybenzoic acid, and wherein said charge adjuvant is incorporated into said thermoplastic resin particles and said thermoplastic resin particles are dispersed in said nonpolar liquid and said liquid soluble charge director.

Many of the above objects have been met by the present invention, in embodiments, which also includes: an imaging method which comprises forming an electrostatic latent image followed by the development thereof with a liquid developer comprising the above disclosed charge control agent.

Many of the above objects have been met by the present invention, in embodiments, which further includes: a method for forming the charge adjuvant above comprising a) mixing an acid from the group $R_2$ and an acid from the group $R_3$ with an alkali solution, b) adding an aluminum compound with heat to form a resulting aqueous aluminum salt of an acid charge adjuvant, c) solidifying said aqueous charge adjuvant.

DETAILED DESCRIPTION OF THE INVENTION

These and other objects of the present invention can be accomplished in embodiments by the provision of liquid developers with certain charge enhancers. In embodiments, the present invention is directed to liquid developers comprised of a liquid, a resin, an optional charge director, and a charge enhancing agent comprised of aluminum salts of acids, specifically, hydroxy carboxylic acids, amino carboxylic acids, aromatic sulfonic acids, aliphatic carboxylic acids, aromatic carboxylic acids, or mixtures thereof.

Embodiments of the present invention relate to a liquid developer comprised of a liquid, thermoplastic resin particles, a nonpolar liquid soluble charge director, and a charge enhancing agent comprised of aluminum salts of an acid selected from amino carboxylic acids, aromatic sulfonic acids, aliphatic carboxylic acids, aromatic carboxylic acids, or mixtures thereof; a liquid developer comprised of a nonpolar liquid, thermoplastic resin particles, a nonpolar liquid soluble ionic or zwitterionic charge director, and a charge enhancing agent comprised of an aluminum salt of an acid selected from hydroxy carboxylic acids, amino carboxylic acids, sulfonic acids, aliphatic carboxylic acids, aromatic carboxylic acids, or mixtures thereof; a liquid electrostatographic developer comprised of a nonpolar liquid, thermoplastic resin particles, a nonpolar liquid soluble ionic or zwitterionic charge director compound, and a charge enhancer comprised of an aluminum salt of an acid selected from hydroxy carboxylic acids, amino carboxylic acids, sulfonic acids, aliphatic carboxylic acids, aromatic carboxylic acids, or mixtures thereof, or a liquid electrostatographic developer comprised of (A) a nonpolar liquid having a Kauri-butanol value of from about 5 to about 30, and present in a major amount of from about 50 percent to about 99 weight percent, and pigment (B) thermoplastic resin particles preferably with an average volume particle diameter of from about 1 to about 30 microns, (C) a nonpolar liquid soluble ionic or zwitterionic charge director compound, and (D) a charge enhancer comprised of aluminum salts of an acid selected from aluminum hydroxy carboxylic acid salts, aluminum amino carboxylic acid salts, aluminum sulfonic acid salts, aluminum aliphatic carboxylic acid salts, aluminum aromatic carboxylic acid salts, the corresponding hydrates, and mixtures thereof.

Examples of specific charge enhancing agents present in various effective amounts of, for example, from about 0.25 to about 15, and preferably from about 0.5 to about 5 weight percent based on the weight percent of resin, pigment and charge additive or the solid components include: an aluminum salt having the formula $R_1R_2R_3Al$, wherein $R_1$ is OH; $R_2$ is selected from the group consisting of OH, hydroxy carboxylic acids, alpha or beta amino acids with primary, and secondary or tertiary amino groups; and $R_3$ is selected from the group consisting of hydroxy carboxylic acids, alpha or beta amino acids with primary, secondary or tertiary amino groups, and a compound of the following formula (a):

(a)

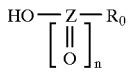

n=1 or 2; Z=carbon or sulfur wherein, when Z is carbon, n is 1 and $R_o$ is selected from the group consisting of hydrogen, alkyl of from about 1 to about 20 carbons, alkenyl at from about 2 to about 20 carbons, cycloalkyl of from about 3 to about 7 carbons, aryl of from about 6 to about 18 carbons, alkylaryl of from about 7 to about 40 carbons, cycloalkylaryl of from about 8 to about 40 carbons and heteroaryl of from about 6 to about 18 carbons including heteroatoms of oxygen, nitrogen and sulfur, wherein $R_o$ may be substituted with alkoxy of from about 2 to about 20 carbons, carboalkoxy of from about 2 to about 20 carbons, alkoxy carbonyl of from about 2 to about 20 carbons, carboxamido, aldehydo, sulfonamido, nitro, cyano, and halogen groups, and when Z is sulfur, n is 2 and $R_o$ is selected from an aryl of from about 6 to about 18 carbons, alkylaryl of from about 7 to about 40 carbons, cycloalkylaryl of from about 8 to about 40 carbons and heteroaryl of from about 6 to about 18 carbons including heteroatoms of oxygen, nitrogen and sulfur, and wherein $R_o'$ may be substituted with alkoxy of from about 2 to about 20 carbons or carboalkoxy of from about 2 to about 20 carbons, with the provision that when $R_2$ is 3,5-di-t-butyl salicylic acid, $R_3$ is not a salicylic acid or an alkoxybenzoic acid and wherein the charge adjuvant is incorporated into the thermoplastic resin particles and the thermoplastic resin particles are dispersed in the nonpolar liquid and the liquid soluble charge director.

In an embodiment of the invention, at least one of $R_2$ and $R_3$ is a hydroxy aliphatic carboxylic acid. The aliphatic hydroxy carboxylic acids of the present invention preferably contain an alpha and beta aliphatic hydroxy carboxylic acid. Examples of aliphatic and aromatic hydroxy carboxylic acids include, but are not limited to a compound having the following general formula (b):

(b)

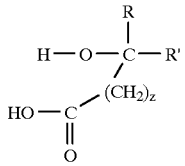

wherein R and R' are selected from the group consisting of hydrogen, alkyl of from about 1 to about 20 carbons, cycloalkyl of from about 3 to about 7 carbons, aryl of from about 6 to about 18 carbons, alkylaryl of from about 7 to about 40 carbons; wherein R or R' may be substituted with alkoxy of from about 2 to about 20 carbons, carboalkoxy of from about 2 to about 20 carbons, alkoxy carbonyl of from about 2 to about 20 carbons, carboxamido, aldehydo, sulfonamido, nitro, cyano, and halogen groups; and z is 0 or 1. Preferred are aliphatic alpha or beta hydroxy carboxylic acids and aromatic ortho hydroxy carboxylic acids. Specific examples of preferred aliphatic hydroxy carboxylic acids include 2-hydroxy butyric acid, 3-hydroxy butyric acid, 2-hydroxy valeric acid, and 2-hydroxy caproic acid. Examples of preferred aromatic hydroxy carboxylic acids include 3,5-di-t-butyl salicylic acid, 3,5-diisopropyl salicylic acid, 3,5-diethyl salicylic acid, 3,5-dimethyl salicylic acid, 3,5-dichloro salicylic acid, 3,5-dinitro salicylic acid, 2-hydroxy-1-biphenyl carboxylic acid, 2-hydroxy-1-naphthalene carboxylic acid, phenylglycolic acid, naphthylglycolic acid, 1-hydroxycyclohexane carboxylic acid, 2-hydroxycyclohexane carboxylic acid and 1-hydroxy-2-naphthalene carboxylic acid. Any monofunctional hydroxy carboxylic acid can be used; yet, 3,5-di-t-butyl salicylic acid is preferred as one of $R_2$ and $R_3$, but not for both. However, when $R_2$ is 3,5-di-t-butyl salicylic acid, $R_3$ is not an alkoxybenzoic acid or a salicylic acid. It is preferred that when an aromatic hydroxy carboxylic acid group is present for at least one of $R_2$ and $R_3$, and when the aromatic hydroxy carboxylic acid has both the hydroxy group and the carboxylic acid group bonded to the aluminum atom, the compound must be an ortho-aromatic carboxylic acid so that both groups are in close proximity to the aluminum atom.

In embodiments, the present invention may include sulfonic acids, aromatic carboxylic acids, or aliphatic carboxylic acids representative of $R_3$ in the formula $AlR_1R_2R_3$. Examples of sulfonic acids, aromatic carboxylic acids or aliphatic carboxylic acids include a compound of the following formula (a):

(a)

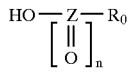

n=1 or 2; Z=carbon or sulfur wherein, when Z is carbon, n is 1 and $R_o$ is selected from the group consisting of hydrogen, alkyl such as methyl of from about 1 to about 20 carbons, alkenyl such as methylene of from about 2 to about 20 carbons, cycloalkyl such as cyclohexane of from about 3 to about 7 carbons, aryl such as phenyl of from about 6 to about 18 carbons, alkylaryl of from about 7 to about 40 carbons, cycloalkylaryl of from about 8 to about 40 carbons and heteroaryl of from about 4 to about 18 carbons including heteroatoms of oxygen, nitrogen and sulfur, wherein $R_o$ may be substituted with alkoxy of from about 2 to about 20 carbons, carboalkoxy of from about 2 to about 20 carbons, alkoxy carbonyl of from about 2 to about 20 carbons, carboxamido, aldehydo, sulfonamido, nitro, cyano, and halogen groups, and when Z is sulfur, n is 2 and $R_o$ is selected from the group consisting of an aryl of from about 6 to about 18 carbons, alkylaryl of from about 7 to about 40 carbons, cycloalkylaryl of from about 8 to about 40 carbons and heteroaryl of from about 4 to about 18 carbons including heteroatoms of oxygen, nitrogen and sulfur, and wherein $R_o$ may be substituted with alkoxy of from about 2 to about 20 carbons or carboalkoxy of from about 2 to about 20 carbons.

Specific examples of the aromatic or aliphatic carboxylic acids and the sulfonic acids include p-toluic acid, benzoic acid, 2,5 dimethylbenzene sulfonic acid, 2-furoic acid, 2-phenoxybutyric acid, nicotinic acid, acetylsalicylic acid, furylacrylic acid, p-toluene sulfonic acid, 5-butylpicolinic acid, and 2-nonenoic acid, alpha and beta naphthoic acids, cinnamic acid, p-biphenyl carboxylic acid, mesitoic acid, 3-nitrobenzoic acid, acrylic acid, methacrylic acid, crotonic acid, formic acid, acetic acid, trichloroacetic acid, trifluoroacetic acid, methoxyacetic acid, phenylacetic acid, propionic acid, butyric acid, dodecanoic acid, cyclohexane carboxylic acid, 3-chloropropionic acid, 3-ketobutyric acid, pyruvic acid, 4-dodecylbenzene sulfonic acid, and benzene sulfonic acid.

It is preferred that when $R_1$ is OH and $R_3$ is an aromatic or aliphatic carboxylic acid or sulfonic acid, that $R_2$ is either an alpha or beta hydroxy carboxylic acid, or an amino carboxylic acid. In other words, only $R_3$ can be an aromatic or aliphatic carboxylic acid or sulfonic acid.

In a particularly preferred embodiment of the present invention, $R_1$ is OH, $R_2$ is a hydroxy carboxylic acid, particularly preferred is 3,5 di-t-butyl salicylic acid, and $R_3$ is selected from the group consisting of p-toluic acid, benzoic acid, 2,5 dimethylbenzene sulfonic acid, 2-furoic acid, 2-phenoxybutyric acid, nicotinic acid, furylacrylic acid, p-toluene sulfonic acid, 5-butylpicolinic acid, and 2-nonenoic acid.

In another embodiment of the invention, at least one of $R_2$ and $R_3$ ia an amino carboxylic acid, particularly an alpha or beta amino acid. It is particularly preferred that the amino carboxylic acid is an alpha or beta amino acid with primary, secondary or tertiary amino groups. Examples of alpha or beta amino acids with primary, secondary or tertiary amino groups useful in the present invention include a compound represented by the following two general formulas (c):

(c1)

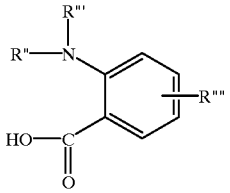

Beta Aromatic Amino-Aromatic Carboxylic Acid (c2)

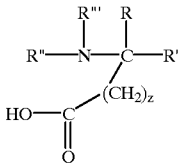

Alpha or Beta Aliphatic or Aromatic Amino-Aliphatic Carboxylic Acid wherein z is 0 or 1, R, R', R" and R'" are selected from the group consisting of hydrogen, alkyl of from about 1 to about 20 carbons, cycloalkyl of from about 3 to about 7 carbons, aryl of from about 6 to about 18 carbons, alkylaryl of from about 7 to about 40 carbons; R"" is selected from alkyl of from about 1 to about 20 carbons, aryl of from about 4 to about 18 carbons, fused aromatic, fused cycloaliphatic, nitro, halogen, cyano, alkoxy of from about 2 to about 20 carbons, carboalkoxy of from about 2 to about 20 carbons, alkoxy carbonyl of from about 2 to about 20 carbons, carboxamido, aldehydo, and sulfonamido. Fused refers to fused, bonded or attached. Preferred are alpha or beta aliphatic amino acids with primary, secondary or tertiary amino groups and ortho aromatic amino acids with primary, secondary or tertiary amino groups. Specific examples include glycine, alanine, valine, leucine, serine, threonine, isoleucine, 2-aminobutyric acid, 2-methylaminobutyric acid, 2-dimethylaminobutyric acid, N-phenylalanine, proline, tryptophan, isoserine, methionine, histidine, methylamino acetic acid, dimethylamino acetic acid, anthranlic acid, N, N-dimethylanthranilic acid, 4-chloroanthranilic acid, and 2-amino-1-naphthoic acid.

Specific examples of charge control agents useful in the present invention include, but are not limited to hydroxy (3,5-di-tertiary-butyl salicylic-co-nonenoic) aluminate, hydroxy (3,5-di-tertiary-butyl salicylic-co-benzoic) aluminate, hydroxy (3,5-di-tertiary-butyl salicylic-co-2,5-dimethylbenzene sulfonic) aluminate, hydroxy (3,5-di-tertiary-butyl salicylic-co-p-toluic) aluminate, hydroxy (3,5-di-tertiary-butyl salicylic-co-2-furoic) aluminate, hydroxy (3,5-di-tertiary-butyl salicylic-co-p-toluene sulfonic) aluminate, hydroxy (3,5-di-tertiary-butyl salicylic-co-nicotinic) aluminate, hydroxy (3,5-di-tertiary-butyl salicylic-co-furylacrylic) alumninate, hydroxy (3,5-di-tertiary-butyl salicylic-co-2-phenoxybutyric) aluminate, hydroxy (3,5-di-tertiary-butyl salicylic-co-2-hydroxy1-naphthoic) aluminate, hydroxy bis (2-hydroxy-1-naphthoic) aluminate, hydroxy (glycine-co-3,5-di-tertiary-butyl salicylic) aluminate, hydroxy (glycine-co-p-toluene sulfonic) aluminate, and hydroxy (alanine-co-nonenoic) aluminate, hydroxy (3,5-di-tertiary-butyl salicylic-co-anthranilic) alumninate and hydroxy (3,5-di-tertiary-butyl salicylic-co-N,N-dimethylanthranilic) aluminate.

Further, in embodiments of this invention, mixtures of the aluminum salts of the acids heretofore described are expressed in molar ratios of the acids charged in the preparation of said aluminum salts and in molar ratios of products obtained therefrom. A simple statistical equation describes this relationship wherein x represents moles of $R_2$ acid and y represents moles of $R_3$ acid charged in the synthesis of the aluminum salt. The moles of aluminum salt products containing (1) only $R_2$ acids as ligands and (2) a mixture of $R_2$ and $R_3$ acids as ligands and (3) only $R_3$ acids as ligands is then calculated from the equation $x^2+2xy+y^2$ wherein the $x^2$ term gives moles of only $R_2$ ligand aluminum salt product and the 2xy term gives moles of the mixed aluminum salt product containing one $R_2$ ligand and one $R_3$ ligand and the $y^2$ term gives moles of only $R_3$ ligand aluminum salt product. Summation of these three molar values gives the total moles of all aluminum salt products from which the percent molar composition of each aluminum salt product in the mixture can then be calculated. Thus if equimolar amounts of two acids in the amounts of x and y equal to 1 mole each (where x is the $R_2$ acid and y is the $R_3$ acid) are charged in the synthesis step then the resulting aluminum salt product molar ratio will be 1:2:1 and the aluminum salt mole percent composition will be 25:50:25 according to the above equation.

Examples of liquid carriers selected for the developers of the present invention include a liquid with viscosity of from about 0.5 to about 500 centipoise, preferably from about 1 to about 20 centipoise, and a resistivity greater than or equal to $5\times10^9$ ohm/centimeters, such as $10^{13}$ ohn/cm or more. Preferably, the liquid selected in embodiments is a branched chain aliphatic hydrocarbon having preferably from about 12 to about 16 carbon atoms. A nonpolar liquid of the ISOPAR® series (manufactured by the Exxon Corporation)

may also be used for the developers of the present invention. These hydrocarbon liquids are considered narrow portions of isoparaffmnic hydrocarbon fractions with extremely high levels of purity. For example, the boiling range of ISOPAR G® is between about 157° C. and about 176° C.; ISOPAR H® is between about 176° C. and about 191° C.; ISOPAR K is between about 177° C. and about 197° C. ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are known and should have an electrical volume resistivity in excess of $10^9$ ohm-centimeters and a dielectric constant below or equal to 3.0. Moreover, the vapor pressure at 25° C. should be less than or equal to 10 Torr in embodiments.

While the ISOPAR® series liquids are the preferred nonpolar liquids in embodiments for use as dispersants in the liquid developers of the present invention, the important characteristics of viscosity and resistivity can be achieved it is believed with other suitable liquids. Specifically, the NORPAR® series available from Exxon Corporation, the SOLTROL® series from the Phillips Petroleum Company, and the SHELLSOL® series from the Shell Oil Company can be selected.

The amount of the liquid employed in the developer of the present invention is from about 90 to about 99.9 percent, and preferably from about 95 to about 99 percent by weight of the total developer dispersion. The total solids content of the developers is, for example, 0.1 to 10 percent by weight, preferably 0.3 to 3 percent, and more preferably, 0.5 to 2.0 percent by weight.

Any suitable thermoplastic toner resin can be selected for the liquid developers of the present invention in effective amounts of, for example, in the range of 99 percent to 40 percent of developer solids, and preferably 95 percent to 70 percent of developer solids; developer solids include the thermoplastic resin, optional pigment and charge control agent and any other component that comprises the particles. Examples of such resins include ethylene vinyl acetate (EVA) copolymers (ELVAX® resins, E. I. DuPont de Demours and Company, Wilmington, Del.); copolymers of ethylene and an alpha-beta-ethylenically unsaturated acid selected from the group consisting of acrylic acid and methacrylic acid; copolymers of ethylene (80 to 99.9 percent), acrylic or methacrylic acid (20 to 0.1 percent)/alkyl (C1 to C5) ester of methacrylic or acrylic acid (0.1 to 20 percent); polyethylene; polystyrene; isotactic polypropylene (crystalline); ethylene ethyl acrylate series sold under the trademark BAKELITE® DPD 6169, DPDA 6182 Natural (Union Carbide Corporation); ethylene vinyl acetate resins, for example DQDA 6832 Natural 7 (Union Carbide Corporation); SURLYN® ionomer resin (E. I. de Nemours and Company); or blends thereof; polyesters; polyvinyl toluene; polyamides; styrene/butadiene copolymers; epoxy resins; acrylic resins, such as copolymer of acrylic or methacrylic acid and at least one alkyl ester of acrylic or methacrylic acid wherein alkyl is from 1 to about 20 carbon atoms, like methyl methacrylate (50 to 90 percent)/methacrytic acid (0 to 20 percent/ethylhexylacrylate (10 to 50 percent); and other acrylic resins including ELVACITE® acrylic resins (E. I. DuPont de Nemours and Company); or blends thereof. Preferred copolymers are the copolymer of ethylene and an alpha-beta-ethylenically unsaturated acid of either acrylic acid or methacrylic acid. In a preferred embodiment, NUCREL®, like NUCREL® 599, NUCREL® 699, or NUCREL® 960 are selected as the thermoplastic resin.

The liquid developer of the present invention may optionally contain a colorant dispersed in the resin particles. Colorants, such as pigments or dyes and mixtures thereof, are preferably present to render the latent image visible.

The colorant may be present in the resin particles in an effective amount of, for example, from about 0.1 to about 60 percent, and preferably from about 1 to about 30 percent by weight based on commercially available the total weight of solids contained in the developer. The amount of colorant used may vary depending on the use of the developer. Examples of colorants include commercially available pigments like carbon blacks, REGAL 330®, cyan, magenta, yellow, blue, green, brown and mixtures thereof; pigments as illustrated in U.S. Pat. No. 5,223,368, the disclosure of which is totally incorporated herein by reference in its entirety, and more specifically, the following:

| PIGMENT BRAND NAME | MANUFACTURER | COLOR |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chemical | Yellow 14 |
| L75-1331 | Sun Chemical | Yellow 17 |
| Hansa Yellow RA | Hoechst | Yellow 73 |
| Hansa Brilliant Yellow 5GX-02 | Hoechst | Yellow 74 |
| DALAMAR ® YE;;PW UT-858-D | Heubach | Yellow 74 |
| Hansa Yellow X | Hoechst | Yellow 75 |
| NOVAPERM ® YELLOW HR | Hoechst | Yellow 83 |
| L75-2337 | Sun Chemical | Yellow 83 |
| CROMOPHTHAL ® YELLOW 3G | Ciba-Geigy | Yellow 93 |
| CROMOPHTHAL ® YELLOW GR | Ciba-Geigy | Yellow 95 |
| NOVAPERM ® YELLOW FGL | Hoechst | Yellow 97 |
| Hansa Brilliant Yellow 10GX | Hoechst | Yellow 98 |
| LUMOGEN ® LIGHT YELLOW | BASF | Yellow 110 |
| Permanent Yellow G3R-01 | Hoechst | Yellow 114 |
| CROMOPHTHAL ® YELLOW 8G | Ciba-Geigy | Yellow 128 |
| IRGAZINE ® YELLOW 5GT | Ciba-Geigy | Yellow 129 |
| HOSTTAPERM ® YELLOW H4G | Hoechst | Yellow 151 |
| HOSTTAPERM ® YELLOW H3G | Hoechst | Yellow 154 |
| HOSTAPERM ® ORANGE GR | Hoechst | Orange 43 |
| PALIOGEN ® ORANGE | BASF | Orange 51 |
| IRGALITE ® RUBINE 4BL | Ciba-Geigy | Red 57:1 |
| QUINDO ® MAGENTA | Mobay | Red 122 |
| INDOFAST ® BRILLIANT SCARLET | Mobay | Red 123 |
| HOSTAPERM ® SCARLET GO | Hoechst | Red 168 |
| Permanent Rubine F6B | Hoechst | Red 184 |
| MONASTRAL ® MAGENTA | Ciba-Geigy | Red 202 |
| MONSTRAL ® SCARLET | Ciba-Geigy | Red 207 |
| HELIOGEN ® BLUE L 6901f | BASF | Blue 15:2 |
| HELIOGEN ® BLUE TBD 7010 | BASF | Blue 3 |
| HELIOGEN ® BLUE K 7090 | BASF | Blue 15:3 |
| HELIOGEN ® BLUE L 7201F | BASF | Blue 15:4 |
| HELIOGEN ® BLUE L 6470 | BASF | Blue 60 |
| HELIOGEN ® GREEN K 8683 | BASF | Green 7 |
| HELIOGEN ® GREEN L 9140 | BASF | Green 36 |
| MONASTRAL ® VIOLET | Ciba-Geigy | Violet 19 |
| MONASTRAL ® RED | Ciba-Geigy | Violet 19 |
| QUINDO ® RED 6700 | Mobay | Violet 19 |
| QUINDO ® RED 6713 | Mobay | Violet 19 |
| INDOFAST ® VIOLET | Mobay | Violet 19 |
| MONASTRAL ® VIOLET Maroon B | Ciba-Geigy | Violet 42 |
| STERLING ® NS BLACK | Cabot | Black 7 |
| STERLING ® NSX 76 | Cabot | |

-continued

| PIGMENT BRAND NAME | MANUFACTURER | COLOR |
|---|---|---|
| TIPURE ® R-191 | DuPont | White 6 |
| MOGUL ® L | Cabot | Black, C1 77266 |
| UHLICH ® bk 8200 | Paul Uhlich | Black |

Suitable nonpolar liquid soluble ionic or zwitterionic charge director compounds which are selected in various effective amounts such as about 0.25 to 1,500 milligrams/gram, preferably 2.5 to 400 milligrams/gram based on the amount of developer solids comprised of resin, pigment, and charge adjuvant, include anioic glyceride, such as EMPHOS D70-30C TM and EMPHOS F27-85®, MSSN 505043, D/94028I, the disclosure of which is totally incorporated herein by reference, two products available from Witco Corporation, New York, N.Y.; which sodium salts of phosphated mono and diglycerides with unsaturated and saturated acid substituents, respectively, lecithin, BASIC BARIUM PETRONATE®, NEUTRAL BARIUM PETRONATE®, CALCIUM PETRONATE®, NEUTRAL CALCIUM PETRONATE®, oil soluble petroleum, Witco Corporation, New York, N.Y.; and metallic soaps such as barium, calcium, lead, and zinc stearates; cobalt, manganese, lead, and zinc linoleates, calcium and cobalt octoates; quaternary ammonium block copolymers as illustrated, for example, in U.S. Pat. No. 5,035,972, the disclosure of which is totally incorporated herein by reference, and the like.

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is required for image development and background cleaning.

Toner particle mobility can be measured using the electroacoustics effect, the application of an electric field, and the measurement of sound reference Oja et. al. U.S. Pat. No. 4,497,208, the disclosure of which is totally incorporated herein by reference in its entirety. This technique is particularly useful for dispersions because the measurements can be made at high volume loadings, for example, greater than or equal to 1.5 to 10 weight percent. Measurements made by this technique have been shown to correlate with image quality, for example high mobilities can lead to improved image density, resolution and improved transfer efficiency. Residual conductivity, that is the conductivity from the charge director, is measured using a low field device as illustrated in the following Examples.

The liquid electrostatic developer of the present invention can be prepared by a variety of known processes such as, for example, mixing in a nonpolar liquid the thermoplastic resin, nonpolar liquid charging additive and colorant in a manner that the resulting mixture contains, for example about 15 to about 30 percent by weight of solids; heating the mixture to a temperature from about 70° C. to about 130° C. until a uniform dispersion is formed; adding an additional amount of nonpolar liquid sufficient to decrease the total solids concentration of the developer to about 10 to 20 percent by weight; cooling the dispersion to about 10° C. to about 50° C.; adding the charge adjuvant compound to the dispersion; and diluting the dispersion.

In the initial mixture, the resin, colorant and charge adjuvant may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer (manufactured by Charles Ross and Son, Hauppauge, N.Y.), or a two roll heated mill, which requires no particulate media. Useful particulate media include particulate materials like a spherical cylinder selected from the group consisting of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters).

Sufficient liquid, especially preferred nonpolar liquid, is added to provide a dispersion of from about 15 to about 50 percent solids. This mixture is subjected to elevated temperatures during the initial mixing procedure to plasticize and soften the resin. The mixture is sufficiently heated to provide a uniform dispersion of all solid materials, that is colorant, adjuvant and resin. However, the temperature at which this step is undertaken should not be so high as to degrade the nonpolar liquid or decompose the resin or colorant when present. Accordingly, the mixture is heated to a temperature of from about 70° C. to about 130° C., and preferably to about 75° C. to about 110° C. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the dispersion. The amount of nonpolar liquid to be added at this point should be an amount sufficient to decrease the total solids concentration of the dispersion to from about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid, such as water, ethylene glycol, and the like in a jacket surrounding the mixing vessel. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding by means of particulate media, or with stirring to form a viscous mixture and grinding by means of particulate media. The resin precipitate is cold ground for about 1 to 36 hours, and preferably 2 to 6 hours. Additional liquid may be added at any step during the preparation of the liquid developer to facilitate grinding or to dilute the developer to the appropriate percent solids needed for developing. Methods for the preparation of toners that can be selected are illustrated in U.S. Pat. Nos. 4,760,009; 5,017,451; 4,923,778 and 4,783,389, the disclosures of which are totally herein by reference in their entirety.

As illustrated herein, the developers or inks of the present invention can be selected for imaging and printing methods wherein, for example, a latent image is formed on a photoconductive imaging member, reference for example selenium, selenium alloys, those of U.S. Pat. No. 4,265,990, the disclosure of which is totally incorporated herein by reference, and the like; followed by development with the toner of the present invention by, for example, immersion of the imaging member in the liquid toner; transfer to a suitable substrate like paper; and fixing by heating.

The following Examples further define and describe embodiments of the present invention. Unless otherwise indicated, all parts and percentages are by weight.

EXAMPLES

Specific embodiments of the invention will now be described in detail. These examples are intended to be illustrative, and the invention is not limited to the materials, conditions, or process parameters set forth in these embodiments. All parts are percentages by weight unless otherwise indicated.

Control Example 1

Preparation of a Yellow Liquid Toner Concentrate and Ink Without CCA (Control 1)

An amount of 170.4 grams of NUCREL 599® (a copolymer of ethylene and methacrylic acid with a melt index at 190° C. of 500, available from E. I. DuPont de Nemours & Company, Wilmington, Del.), 56.8 grams of the yellow pigment (Paliotol Yellow D1155 TM) and 370.4 grams of Norpar- 15® (Exxon Corporation) were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 56° to 106° C. for 2 hours. An amount of 980.1 grams of Norpar-15® was added to a attritor at the conclusion of the 2 hours, and cooled by running water through the attritor jacket to 23° C., and ground in the attritor for an additional 4 hours. Additional Norpar-15®, about 1500 grams, was added and the mixture was separated from the steel balls.

To 13.87 grams of the mixture (7.21 percent solids), were added 85.53 grams of Norpar-15® and 0.6 gram of a 5.0 weight percent charge director solution in Norpar 15 wherein the charge director was about a 4000 Mn AB diblock copolymer, poly [2-ethylhexyl methacrylate (B block)-co-N,N-dimethyl-N-ethyl methacrylate ammonium bromide (A block)]. The toner average by area particle diameter was 1.7 microns measured with a Horiba Capa 300 particle size analyzer. The mobility of the resulting liquid toner was measured and is listed in Table II of Example 2.

Control Example 2

Preparation of a Yellow Liquid Toner Concentrate and Ink Containing 3% Aluminum Stearate as CCA (Control 2)

An amount of 163.6 grams of NUCREL 599® (a copolymer of ethylene and methacrylic acid with a melt index at 190° C. of 500, available from E. I. DuPont de Nemours & Company, Wilmington, Del.), 56.8 grams of the yellow pigment (Paliotol Yellow D1155 TM ), 6.8 grams of Aluminum Stearate (Witco #22 from Witco Corporation) and 307.4 grams of Norpar-15® (Exxon Corporation) were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 56° to 106° C. for 2 hours. 980.1 grams of Norpar-15® was added to a attritor at the conclusion of the 2 hours, and cooled by running water through the attritor jacket to 23° C., and ground in the attritor for an additional 4 hours. Additional Norpar-15®, about 1500 grams, was added and the mixture was separated from the steel balls.

To 13.87 grams of the mixture (7.21 percent solids), was added an amount of 85.53 grams of Norpar-15® and 0.6 grams of a 5.0 weight percent charge director solution in Norpar 15 wherein the charge director was about a 4000 Mn AB diblock copolymer, poly (2-ethylhexyl methacrylate (B block)-co-N,N-dimethyl-N-ethyl methacrylate ammonium bromide [A block]). The toner average by area particle diameter was 2.3 microns measured with a Horiba Capa 300 particle size analyzer. The mobility of the resulting liquid toner control was measured and is listed in Table II of Example 2.

Example 1

General Preparation of Charge Control Agents

To 0.04 mole of the selected acid mixture (the $R_2$ and $R_3$ acids) in deionized boiling water was added 0.06 mole (2.4 grams) of sodium hydroxide flake to give a 5 weight percent or less aqueous alkali solution of the sodium salts of the acids (solution A). Similarly aluminum chloride (0.02 mole) was added to boiling deionized water to give a 5 weight percent or less solution (solution B). Solution A was added dropwise to the stirred solution B while maintaining the mixture at about 95 C. Stirring was continued for another 10–15 minutes and then heating was discontinued and the mixture allowed to cool to ambient temperature. The solid charge control agent was gravity filtered through a coarse fritted filter and the solid on the funnel was then washed 3 times with more deionized water until the pH of the washings was about 6 to 7. The washed sample of charge control agent was air dried overnight (about 18 hours) and then air dried to constant weight. The weights and molar quantities of the $R_2$ and $R_3$ acid reactants and the isolated weights and yields of charge control agent products are given in Table I.

TABLE I

Weights and Molar Quantities of the $R_2$ and $R_3$ Acid Reactants and Weights and Yields of Isolated CCA Products

| CCA Example No. | $R_2$ Acid Reactant | Grams $R_2$ Acid | Moles $R_2$ Acid | $R_3$ Acid Reactant | Grams $R_3$ Acid | Moles $R_3$ Acid | Grams CCA Product | % Yield CCA Product |
|---|---|---|---|---|---|---|---|---|
| 1A | 3,5-di-t-BSA | 8.01 | 0.032 | 2-nonenoic acid | 5.0 | 0.032 | 13.15 | 91.5 |
| 1B | 3,5-di-t-BSA | 7.5 | 0.03 | benzoic acid | 3.66 | 0.03 | 12.7 | 99.9 |

TABLE I-continued

Weights and Molar Quantities of the $R_2$ and $R_3$ Acid Reactants and Weights and Yields of Isolated CCA Products

| CCA Example No. | $R_2$ Acid Reactant | Grams $R_2$ Acid | Moles $R_2$ Acid | $R_3$ Acid Reactant | Grams $R_3$ Acid | Moles $R_3$ Acid | Grams CCA Product | % Yield CCA Product |
|---|---|---|---|---|---|---|---|---|
| 1C | 3,5-di-t-BSA | 5.0 | 0.02 | 2,5-dimethyl benzene sulfonic acid | 4.44 | 0.02 | 8.3 | 81 |
| 1D | 3,5-di-t-BSA | 5.0 | 0.02 | p-toluic acid | 2.72 | 0.02 | 8.31 | 96 |
| 1E | 3,5-di-t-BSA | 5.0 | 0.02 | 2-furoic acid | 2.24 | 0.02 | 7.03 | 86 |
| 1F | 3,5-di-t- | 5.0 | 0.02 | p-toluene sulfonic acid | 3.44 | 0.02 | 6.17 | 66.1 |
| 1G | 3,5-di-t-BSA | 2.5 | 0.01 | nicotinic acid | 1.23 | 0.02 | 3.51 | 84 |
| 1H | 3,5-di-t-BSA | 5.0 | 0.02 | furylacrylic acid | 2.76 | 0.02 | 8.37 | 96.7 |
| 1I | 3,5-di-t-BSA | 5.0 | 0.02 | 2-phenoxy butyric acid | 3.60 | 0.02 | 8.76 | 92.2 |

3,5-di-t-BSA is 3,5-di-t-butylsalicylic acid

Example 2

General Preparation For Yellow Liquid Toner Concentrates and Inks Yellow Liquid Toner Concentrate and Ink Preparation Containing 2% of 3,5-di-t-BSA/2-Nonenoic Acid Hydroxy Aluminate Salt CCA An amount of 165.9 grams of NUCREL 599® (a copolymer of ethylene and methacrylic acid with a melt index at 190° C. of 500, available from E. I. DuPont de Nemours & Company, Wilmington, Del.), 56.8 grams of the yellow pigment (Paliotol Yellow D1155 TM ), 4.54 grams of the aluminum complex charge additive of Example IA charge control agent [hydroxy (3,5-di-tertiary-butyl salicylic-co-2-nonenoic acid) aluminate and 370.4 grams of Isopar-M® (Exxon Corporation) were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 56° to 106° C. for 2 hours. An amount of 980.1 grams of Isopar-M® was added to the attritor at the conclusion of the 2 hours, cooled by running water through the attritor jacket to 23° C., and ground in the attritor for an additional 4 hours. Additional Isopar-M®, about 650 grams, was added and the mixture was separated from the steel balls.

To 10.47 grams of the mixture (9.55 percent solids) were added 39.43 grams of Isopar-M®, 49.50 grams Superla White Mineral Oil #5 (Exxon Corporation) and 0.6 gram of a 5.0 weight percent charge director solution in Isopar M wherein the charge director was about a 4000 Mn AB diblock copolymer, poly [2-ethylhexyl methacrylate (B block)-co-N,N-dimethyl-N-ethyl methacrylate ammonium bromide (A block)]. The toner average by area particle diameter was 3.2 microns measured with a Horiba Capa 500 particle size analyzer. The ESA mobilities and of this liquid toner and all the liquid toners so prepared containing the hydroxy aluminate charge control agents (1A–1E) and controls 1 and 2 were measured (Table II).

TABLE II

ESA Mobility Data for Yellow Developers Containing Hydroxy Aluminate CCAs and Control Developers

| Liquid Toner or Developer No. | CCA No. | $R_2$ Acid Ligand in CCA | $R_3$ Acid Ligand in CCA | ESA Zeta Potentials in −1* mv | ESA Mobilities in $m^2/Vs^*$ $1E^{-10}$ |
|---|---|---|---|---|---|
| 2A | 1A | 3,5-di-t-BSA | 2-nonenoic acid | 535.3 | 2.31 |
| 2B | 1B | 3,5-di-t-BSA | benzoic acid | 439.3 | 2.16 |
| 2C | 1C | 3,5-di-t-BSA | 2,5-dimethyl benzene sulfonic acid | 460.2 | 2.21 |
| 2D | 1D | 3,5-di-t-BSA | p-toluic acid | 459.8 | 2.19 |
| 2E | 1E | 3,5-di-t-BSA | 2-furoic acid | 455.3 | 2.39 |
| 2F | 1F | 3,5-di-t-BSA | p-toluene sulfonic acid | 483.4 | 2.14 |
| 2G | 1G | 3,5-di-t-BSA | nicotinic acid | 530.0 | 2.46 |
| 2H | 1H | 3,5-di-t-BSA | furylacrylic acid | 491.9 | 2.37 |
| 2I | 1I | 3,5-di-t-BSA | 2-phenoxy-butyric acid | 487.1 | 2.37 |
| 2J-Control 1 | None | — | — | −184.0 | 0.72 |
| 2K-Control 2 | Aluminum Stearate Witco #22 | stearic acid | stearic acid | −297.0 | 1.07 |

Toner particle mobilities and zeta potentials were determined with a MBS-8000 electrokinetic sonic analysis (ESA) system (Matec Applied Science Hopkinton, Mass.). The system was calibrated in the aqueous mode per manufacturer's recommendation to give an ESA signal corresponding to a zeta potential of —26 mv for a 10 percent (v/v) suspension of LUDOX TM (DuPont). The system was then set up for nonaqueous measurements. The toner particle mobility is dependent on a number of factors including particle charge and particle size. The ESA system also calculates the zeta potential which is directly proportional to toner charge and is independent of particle size.

In Table II above, the ESA mobility and zeta potential data demonstrate the effective charging of liquid developers containing 2% of the charge control agents embodied herein. For effective charging to occur, zeta potentials of at least 200 mv are required. The controls for the samples are (1) the liquid developer without a charge control agent and (2) the liquid developer with 3% aluminum stearate as charge control agent, as prepared in Controls 1 and 2 above. It is clear from the zeta potential and mobility data in Table II that the charge control agents of the present invention provide significantly higher charging levels versus the controls. The developers of the present invention demonstrate zeta potentials ranging from 439 to 535 all of which are significantly higher than the charging levels of the controls even when aluminum stearate is present at the higher 3 weight percent in control 2.

FIG. 5 demonstrates the comparison of zeta potentials the various charge control agents. As set forth above, a toner must have a zeta potential of at least 200 mv to be effective. The control agents of the present invention demonstrate superior zeta potentials well above the 200 mark and generally ranging from 425 to 550, more specifically 439 to 535.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

We claim:

1. A negatively charged liquid developer comprising a nonpolar liquid, resin particles, optional pigment, an optional nonpolar liquid soluble ionic or zwitterionic charge director, and a charge adjuvant comprised of an aluminum salt of an acid having the formula $R_1R_2R_3Al$, wherein $R_1$ is OH; $R_2$ is selected from the group consisting of OH, hydroxy carboxylic acids, and alpha or beta amino acids with primary, secondary or tertiary amino groups; and $R_3$ is selected from the group consisting of (1) aliphatic carboxylic acids and aliphatic hydroxy carboxylic acids, (2) alpha or beta amino acid structures with primary, secondary or tertiary amino groups having a formula c1 or c2:

c1

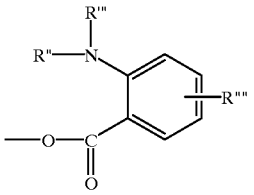

-continued c2

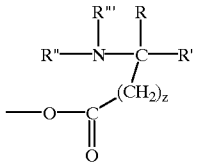

wherein R, R', R" and R'" are selected from the group consisting of hydrogen, alkyl having from about 1 to about 20 carbons, cycloalkyl having from about 3 to about 7 carbons, aryl having from about 6 to about 18 carbons, and alkylaryl having from about 7 to about 40 carbons, and z is 0 or 1, and (3) a group of the following formula (a):

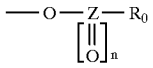

n=1 or 2; Z=carbon or sulfur wherein, when Z is carbon, n is 1 and $R_o$ is selected from the group consisting of hydrogen, alkenyl of from about 2 to about 20 carbons, cycloalkyl of from about 3 to about 7 carbons, alkylaryl of from about 7 to about 40 carbons, cycloalkylaryl of from about 8 to about 40 carbons and heteroaryl of from about 6 to about 18 carbons, wherein $R_o$ may be substituted with alkoxy of from about 2 to about 20 carbons, carboalkoxy of from about 2 to about 20 carbons, alkoxy carbonyl of from about 2 to about 20 carbons, carboxamido, aldehydo, sulfonamido, nitro, cyano, or halogen, and when Z is sulfur, n is 2 and $R_o$ is selected from the group consisting of an aryl of from about 6 to about 18 carbons, alkylaryl of from about 7 to about 40 carbons, cycloalkylaryl of from about 8 to about 40 carbons and heteroaryl of from about 6 to about 18 carbons, R"" is selected from the group consisting of alkyl having from about 2 to about 20 carbons, aryl having from about 4 to about 18 carbons, fused aromatic, fused cycloaliphatic, nitro, halogen, cyano, alkoxy having from about 2 to about 20 carbons, carboalkoxy having from about 2 to about 20 carbons, alkoxy carbonyl having from about 2 to about 20 carbons, carboxamido, aldehydo, and sulfonamido, and z is 1 or 2, and wherein $R_o$ may be substituted with alkoxy of from about 2 to about 20 carbons or carboalkoxy group of from about 2 to about 20 carbons, with the provision that when $R_2$ is 3,5-di-t-butyl salicylic acid, $R_3$ is other than a salicylic acid or an alkoxybenzoic acid, and wherein said charge adjuvant is incorporated into said thermoplastic resin particles and said thermoplastic resin particles are dispersed in said nonpolar liquid and said liquid soluble charge director.

2. A developer in accordance with claim 1, wherein the resin is a thermoplastic resin.

3. A developer in accordance with claim 2, wherein the resin particles are comprised of a copolymer of ethylene and an α,β-ethylenically unsaturated acid selected from the group consisting of acrylic acid and methacrylic acid.

4. A developer in accordance with claim 2, wherein the resin particles are comprised of a styrene polymer, an acrylate polymer, a methacrylate polymer, a polyester, or a mixture thereof.

5. A developer in accordance with claim 2, further containing a colorant, pigment or dye.

6. A developer in accordance with claim 5, the pigment is cyan, magenta, yellow, red, green, blue, brown, or mixtures thereof, or carbon black.

7. A developer in accordance with claim 2, wherein the charge director is present in an amount of from about 0.25 to about 15 weight percent.

8. A developer in accordance with claim 2, wherein the nonpolar liquid is an aliphatic hydrocarbon.

9. A developer in accordance with claim 8, wherein the aliphatic hydrocarbon is a mixture of hydrocarbons with from about 12 to about 16 carbon atoms.

10. A developer in accordance with claim 2, wherein the resin particles are selected from the group consisting of an alkylene polymer, a styrene polymer, an acrylate polymer, a polyester, and mixtures thereof.

11. A developer in accordance with claim 2, wherein the charge adjuvant emits a zeta potential of from about 425 mv to about 550 mv.

12. A developer in accordance with claim 1, wherein at least one of $R_2$ and $R_3$ is an aliphatic hydroxy carboxylic acid selected from the group consisting of glycolic acid, lactic acid, 3-hydroxy propionic acid, 2-hydroxy butyric acid, 3-hydroxy butyric acid, 2-hydroxy valeric acid, and 2-hydroxy caproic acid.

13. A developer in accordance with claim 1, wherein $R_2$ is an aromatic hydroxy carboxylic acid selected from the group consisting of 3,5 di-t-butyl salicylic acids, 3,5-diisopropyl salicylic acid, 3,5-diethyl salicylic acid, 3,5-dimethyl salicylic acid, 3,5-dichloro salicylic acid, 3,5-dinitro salicylic acid, 2-hydroxy-1-biphenyl carboxylic acid, 2-hydroxy-1-naphthalene carboxylic acid, phenylglycolic acid, naphthylglycolic acid, and 1-hydroxy-2-naphthalene carboxylic acid.

14. A developer in accordance with claim 1, wherein at least one of $R_2$ and $R_3$ is an alpha or beta amino acid with primary, secondary or tertiary amino groups selected from the group consisting of glycine, alanine, valine, leucine, serine, threonine, isoleucine, 2-aminobutyric acid, 2-methylarninobutyric acid, 2-dimethylaminobutyric acid, N-phenylalanine, proline, tryptophan, isoserine, methionine, histidine, methylamino acetic acid, dimethylamino acetic acid, anthranlic acid, N,N-dimethylantthranilic acid, 4-chloroanthranilic acid and 2-amino-1-naphthoic acid.

15. A developer in accordance with claim 1, wherein $R_3$ is an aliphatic carboxylic acid of formula (a) selected from the group consisting of 2-furoic acid, 2-nonenoic acid, acrylic acid, methacrylic acid, crotonic acid, formic acid, acetic acid, trichloroacetic acid, trifluoroacetic acid, methoxyacetic acid, propionic acid, butyric acid, dodecanoic acid, 3-chloropropionic acid, 3-ketobutyric acid, and pyruvic acid.

16. A developer in accordance with claim 1, wherein $R_3$ is an aliphatic hydroxy carboxylic acid structure having the following general formula (b):

(b)

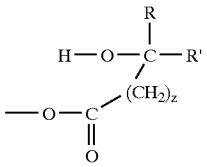

wherein R and R' are selected from the group consisting of hydrogen and an alkyl of from about 1 to about 20 carbons, wherein R or R' may be substituted with an a selected from the group consisting of alkoxy of from 2 to about 20 carbons, carboalkoxy of from 2 to about 20 carbons, alkoxy carbonyl of from about 2 to about 20 carbons, carboxamido, aldehydo, sulfonamido, nitro, cyano, or halogen groups, and z is 0 or 1.

17. An imaging method which comprises forming an electrostatic latent image followed by the development thereof with the liquid developer of claim 1.

18. A negatively charged liquid developer comprising a nonpolar liquid, resin particles, optional pigment, an optional nonpolar liquid soluble ionic or zwitterionic charge director, and a mixed acid charge adjuvant comprised of an aluminum salt of an acid having the formula $R_1R_2R_3Al$, wherein $R_1$ is OH; $R_2$ is 3,5-di-t-butyl salicylic acid; and $R_3$ is selected from the group consisting of hydroxy carboxylic acids, alpha or beta amino acids with primary, secondary or tertiary amino groups, and a group of the following formula (a):

(a)

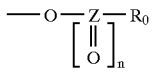

n=1 or 2; Z=carbon or sulfur wherein, when Z is carbon, n is 1 and $R_o$ is selected from the group consisting of hydrogen, alkenyl of from about 2 to about 20 carbons, cycloalkyl of from about 3 to about 7 carbons, aryl of from about 6 to about 18 carbons, alkylaryl of from about 7 to about 40 carbons, cycloalkylaryl of from about 8 to about 40 carbons and heteroaryl of from about 6 to about 18 carbons, wherein $R_o$ may be substituted with alkoxy of from about 2 to about 20 carbons, carboalkoxy of from about 2 to about 20 carbons, alkoxy carbonyl of from about 2 to about 20 carbons, carboxamido, aldehydo, sulfonamido, nitro, cyano, or halogen, and when Z is sulfur, n is 2 and $R_o$ is selected from the group consisting of an aryl of from about 6 to about 18 carbons, alkylaryl of from about 7 to about 40 carbons, cycloalkylaryl of from about 8 to about 40 carbons, heteroaryl of from about 6 to about 18 carbons, and wherein $R_o$ may be substituted with alkoxy of from about 2 to about 20 carbons or carboalkoxy group of from about 2 to about 20 carbons, with the provision that $R_3$ is other than a salicylic acid or an alkoxybenzoic acid, and wherein said charge adjuvant is incorporated into said thermoplastic resin particles and said thermoplastic resin particles are dispersed in said nonpolar liquid and said liquid soluble charge director.

19. A negatively charged liquid developer in accordance with claim 18, wherein $R_3$ is a hydroxy carboxylic acid structure having the following general formula (b):

(b)

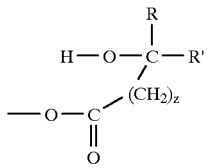

wherein R and R' are selected from the group consisting of hydrogen, alkyl of from about 1 to about 20 carbons, cycloalkyl of from about 3 to about 7 carbons, aryl of from about 6 to about 18 carbons, and alkylaryl of from about 7 to about 40 carbons, wherein R or R' may be substituted with alkoxy of from 2 to about 20 carbons, carboalkoxy of from 2 to about 20 carbons, alkoxy carbonyl of from about 2 to about 20 carbons, carboxamido, aldehydo, sulfonamido, nitro, cyano, or halogen groups and z is 0 or 1.

20. A developer in accordance with claim 19, wherein the charge control adjuvant is selected from the group consisting of hydroxy (3,5-di-tertiary-butyl salicylic-co-nonenoic) aluminate, hydroxy (3,5-di-tertiary-butyl salicylic-co-benzoic) aluminate, hydroxy (3,5-di-tertiary-butyl salicylic-co-2,5-dimethylbenzene sulfonic) aluminate, hydroxy (3,5-di-tertiary-butyl salicylic-co-p-toluic) aluminate, hydroxy (3,5-di-tertiary-butyl salicylic-co-2-furoic) aluminate, hydroxy (3,5-di-tertiary-butyl salicylic-co-p-toluene suftonic) aluminate, hydroxy (3,5-di-tertiary-butyl salicylic-co-nicotinic) aluminate, hydroxy (3,5-di-tertiary-butyl salicylic-co-furylacrylic) aluminate, hydroxy (3,5-di-tertiary-butyl salicylic-co-2-phenoxybutyric) alumninate, hydroxy (3,5-di-tertiary-butyl salicylic-co-2-hydroxy-1-naphthoic) aluminate, hydroxy bis (2-hydroxy-1-naphthoic) aluminate, hydroxy (glycine-co-3,5-di-tertiary-butyl salicylic) aluminate, hydroxy (glycine-co-p-toluene sulfonic) aluminate, and hydroxy (alanine-co-nonenoic) aluminate, hydroxy (3,5-di-tertiary-butyl salicylic-co-anthranitic) aluminate and hydroxy (3,5-di-tertiary-butyl salicylic-co-N,N-dimethylanthranilic) aluminate.

21. A developer in accordance with claim 20, wherein the charge adjuvant is selected from the group consisting of hydroxy (3,5-di-tertiary-butyl-salicylic-co-nonenoic) aluminate, hydroxy (3,5-di-tertiary-butyl-salicylic-co-nicotinic) aluminate, and hydroxy (3,5-di-tertiary-butyl-salicylic-co-furylacrylic) aluminate.

22. A negatively charged liquid developer in accordance with claim 18, wherein $R_3$ is an alpha or beta amino acid structure with primary, secondary or tertiary amino groups having a formula c1 or c2:

(c1)

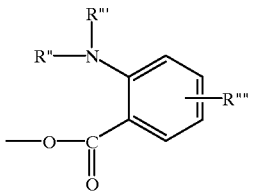

(c2)

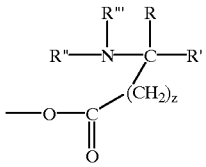

wherein R and R', R" R"' are selected from the group consisting of hydrogen, alkyl having from about 1 to about 20 carbons, cycloalkyl having from about 3 to about 7 carbons, aryl having from about 6 to about 18 carbons, and alkylaryl having from about 7 to about 40 carbons, R"" is selected from the group consisting of alkyl having from about 2 to about 20 carbons, aryl having from about 4 to about 18 carbons, fused aromatic, fused cycloaliphatic, nitro, halogen, cyano, alkoxy having from about 2 to about 20 carbons, carboalkoxy having from about 2 to about 20 carbons, alkoxy carbonyl having from about 2 to about 20 carbons, carboxamido, aldehydo, and sulfonamido, and z is 1 or 2.

23. A negatively charged liquid developer comprising a nonpolar liquid, resin particles, optional pigment, an optional nonpolar liquid soluble ionic or zwitterionic charge director, and a mixed acid charge adjuvant comprised of an aluminum salt of an acid having the formula $R_1R_2R_3Al$, wherein $R_1$ is OH; $R_2$ is selected from the group consisting of hydroxy carboxylic acids and alpha or beta amino acids with primary, secondary or tertiary amino groups; and $R_3$ is selected from the group consisting of hydroxy carboxylic acids, alpha or beta amino acids with primary, secondary or tertiary amino groups, and a group of the following formula (a):

(a)

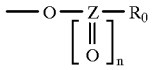

n=1 or 2; Z=carbon or sulfur wherein, when Z is carbon, n is 1 and $R_o$ is selected from the group consisting of hydrogen, alkenyl of from about 2 to about 20 carbons, cycloalkyl of from about 3 to about 7 carbons, aryl of from about 6 to about 18 carbons, alkylaryl of from about 7 to about 40 carbons, cycloalkylaryl of from about 8 to about 40 carbons and heteroaryl of from about 6 to about 18 carbons, wherein $R_o$ may be substituted with alkoxy of from about 2 to about 20 carbons, carboalkoxy of from about 2 to about 20 carbons, alkoxy carbonyl of from about 2 to about 20 carbons, carboxamido, aldehydo, sulfonamido, nitro, cyano, or halogen, and when Z is sulfur, n is 2 and $R_o$ is selected from the group consisting of an aryl of from about 6 to about 18 carbons, alkylaryl of from about 7 to about 40 carbons, cycloalkylaryl of from about 8 to about 40 carbons, and heteroaryl of from about 6 to about 18 carbons, and wherein $R_o$ may be substituted with alkoxy of from about 2 to about 20 carbons or carboalkoxy group of from about 2 to about 20 carbons, with the provision that when $R_2$ is 3,5-di-t-butyl salicylic acid, $R_3$ is other than a salicylic acid or an alkoxybenzoic acid, and with the further proviso that $R_2$ and $R_3$ represent different acid structures, and wherein said charge adjuvant is incorporated into said thermoplastic resin particles and said thermoplastic resin particles are dispersed in said nonpolar liquid and said liquid soluble charge director.

24. A liquid developer in accordance with claim 23, wherein at least one of $R_2$ and $R_3$ is a hydroxy carboxylic acid structure having the following general formula (b):

(b)

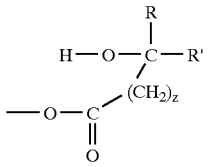

wherein R and R' are selected from the group consisting of hydrogen, alkyl of from about 1 to about 20 carbons, cycloalkyl of from about 3 to about 7 carbons, aryl of from about 6 to about 18 carbons, and alkylaryl of from about 7 to about 40 carbons, wherein R or R' may be substituted with alkoxy of from 2 to about 20 carbons, carboalkoxy of from 2 to about 20 carbons, alkoxy carbonyl of from about 2 to about 20 carbons, carboxamido, aldehydo, sulfonamido, nitro, cyano, or halogen groups, and z is 0 or 1, with the proviso that $R_2$ and $R_3$ represent different acid structures.

25. A liquid developer in accordance with claim 23, wherein at least one of $R_2$ and $R_3$ is an aliphatic hydroxy carboxylic acid selected from the group consisting of glycolic acid, lactic acid, 3-hydroxy propionic acid, 2-hydroxy butyric acid, 3-hydroxy butyric acid, 2-hydroxy valeric acid, and 2-hydroxy caproic acid, with the proviso that $R_2$ and $R_3$ represent different acid structures.

26. A liquid developer in accordance with claim 23, wherein at least one of $R_2$ and $R_3$ is an aromatic hydroxy carboxylic acid selected from the group consisting of 3,5 di-t-butyl salicylic acids, 3,5-diisopropyl salicylic acid, 3,5-diethyl salicylic acid, 3,5-dimethyl salicylic acid, 3,5-dichloro salicylic acid, 3,5-dinitro salicylic acid, 2-hydroxy-1-biphenyl carboxylic acid, 2-hydroxy-1-naphthalene carboxylic acid, phenylglycolic acid, naphthylglycolic acid, and 1-hydroxy-2-naphthalene carboxylic acid, with the proviso that $R_2$ and $R_3$ represent different acid structures.

27. A liquid developer in accordance with claim 23, wherein at least one of $R_2$ and $R_3$ is an alpha or beta amino acid structure with primary, secondary or tertiary amino groups having a formula c1 or c2:

(c1)

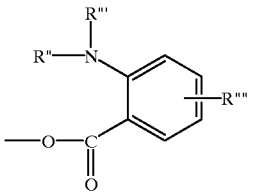

(c2)

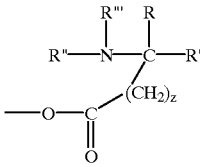

wherein R R', R" and R'" are selected from the group consisting of hydrogen, alkyl having from about 1 to about 20 carbons, cycloalkyl having from about 3 to about 7 carbons, aryl having from about 6 to about 18 carbons, and alkylaryl having from about 7 to about 40 carbons; R"" is selected from the group consisting of alkyl having from about 2 to about 20 carbons, aryl having from about 4 to about 18 carbons, fused aromatic, fused cycloaliphatic, nitro, halogen, cyano, alkoxy having from about 2 to about 20 carbons, carboalkoxy having from about 2 to about 20 carbons, alkoxy carbonyl having from about 2 to about 20 carbons, carboxamido, aldehydo, and sulfonamido, and z is 1 or 2, with the proviso that $R_2$ and $R_3$ represent different acid structures.

28. A liquid developer in accordance with claim 23, wherein at least one of $R_2$ and $R_3$ is an alpha or beta amino acid structure with primary, secondary or tertiary amino groups selected from the group consisting of glycine, alanine, valine, leucine, serine, threonine, isoleucine, 2-aminobutyric acid, 2-methylaminobutyric acid, 2-dimethylaminobutyric acid, N-phenylalanine, proline, tryptophan, isoserine, methionine, histidine, methylamino acetic acid, dimethylamino acetic acid, anthranlic acid, N,N-dimethylantthranilic acid, 4-chloroanthranilic acid and 2-amino-1-naphthoic acid, with the proviso that $R_2$ and $R_3$ represent different acid structures.

29. A liquid developer in accordance with claim 23, wherein $R_3$ is an aliphatic or aromatic carboxylic acid or a sulfonic acid structure of formula (a) selected from the group consisting of p-toluic acid, benzoic acid, 2,5 dimethylbenzene sulfonic acid, 2-furoic acid, 2-phenoxybutyric acid, nicotinic acid, acetylsalicylic acid, furylacrylic acid, p-toluene sulfonic acid, 5-butylpicolinic acid, and 2-nonenoic acid, alpha and beta naphthoic acids, cinnamic acid, p-biphenyl carboxylic acid, mesitoic acid, 3-nitrobenzoic acid, acrylic acid, methacrylic acid, crotonic acid, formic acid, acetic acid, trichloroacetic acid, trifluoroacetic acid, methoxyacetic acid, phenylacetic acid, propionic acid, butyric acid, dodecanoic acid, cyclohexane carboxylic acid, 3-chloropropionic acid, 3-ketobutyric acid, pyruvic acid, 4-dodecylbenzene sulfonic acid, and benzene sulfonic acid, with the proviso that $R_2$ and $R_3$ represent different acid structures.

* * * * *